US011346358B2

(12) United States Patent
Takehana et al.

(10) Patent No.: US 11,346,358 B2
(45) Date of Patent: May 31, 2022

(54) IMPELLER AND CENTRIFUGAL PUMP

(71) Applicant: MIKUNI CORPORATION, Tokyo (JP)

(72) Inventors: Norio Takehana, Iwate (JP); Hideaki Kusanagi, Iwate (JP); Yuichi Mikami, Iwate (JP); Atsushi Sugawara, Iwate (JP); Shin Saito, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 16/826,290

(22) Filed: Mar. 22, 2020

(65) Prior Publication Data

US 2020/0378405 A1 Dec. 3, 2020

(30) Foreign Application Priority Data

May 28, 2019 (JP) ..... JP2019-099370

(51) Int. Cl.
*F04D 29/62* (2006.01)
*F04D 29/22* (2006.01)
(Continued)

(52) U.S. Cl.
CPC ..... *F04D 29/2216* (2013.01); *F04D 29/242* (2013.01); *F04D 29/628* (2013.01);
(Continued)

(58) Field of Classification Search
CPC ..... F04D 25/06; F04D 29/281; F04D 29/167; F04D 29/2216; F04D 29/24;
(Continued)

(56) References Cited

U.S. PATENT DOCUMENTS 4,720,242 A * 1/1988 Lovisetto ..... F04D 29/2222 416/186 A
5,618,168 A * 4/1997 Moon ..... F04D 29/2266 417/423.11

(Continued)

FOREIGN PATENT DOCUMENTS

CN 109169631 3/2019
JP 2006307859 11/2006

(Continued)

OTHER PUBLICATIONS

"Office Action of India Counterpart Application", dated Mar. 28, 2022, with English translation thereof, p. 1-p. 7.

*Primary Examiner* — Dominick L Plakkoottam
(74) *Attorney, Agent, or Firm* — JCIPRNET

(57) ABSTRACT

Provided are an impeller and a centrifugal pump that can be simplified in structure and reduced in weight and cost, and that can be integrally molded by a mold or the like. In a centrifugal pump including a housing having an inlet, an outlet and an impeller chamber, an impeller is disposed in the impeller chamber and is rotationally driven by a driving shaft. The impeller includes: a shaft part connected to the driving shaft to rotate about an axis line extending toward the inlet; blades protruding radially outward from an outer periphery of the shaft part; and an annular shroud plate continuous with the blades so as to cover a tip side area of the blades in order to be disposed adjacent to an inner wall of the housing on the inlet side.

15 Claims, 18 Drawing Sheets

(51) Int. Cl.
*F04D 29/24* (2006.01)
*F04D 29/02* (2006.01)

(52) U.S. Cl.
CPC ..... *F04D 29/026* (2013.01); *F05B 2210/302* (2013.01); *F05B 2240/11* (2013.01); *F05B 2260/305* (2013.01)

(58) Field of Classification Search
CPC ..... F04D 29/023; F04D 29/30; F04D 17/08; F04D 29/162; F04D 29/225; F04D 29/242; F04D 29/282; F04D 29/667
See application file for complete search history.

(56) References Cited

U.S. PATENT DOCUMENTS 6,123,507 A * 9/2000 Weis ..... F04D 29/2277 416/144
8,753,068 B2 * 6/2014 Matsunaga ..... F04D 29/0473 415/104
8,926,275 B2 1/2015 Badafem et al.
9,394,920 B2 * 7/2016 Yamasaki ..... F04D 29/666
10,415,584 B2 * 9/2019 Shoji ..... F04D 29/663
10,517,448 B2 * 12/2019 Shiozawa ..... F04D 25/06
2009/0301485 A1 * 12/2009 Kenyon ..... F04D 29/30 128/204.18
2017/0184116 A1 * 6/2017 Guo ..... F04D 29/086
2017/0268526 A1 * 9/2017 Seok ..... F04D 29/242
2017/0298959 A1 * 10/2017 Boudreaux ..... F04D 29/703
2018/0156233 A1 * 6/2018 Sawada ..... F04D 29/44
2019/0331125 A1 * 10/2019 Hattori ..... F04D 29/167

FOREIGN PATENT DOCUMENTS

JP 2007239731 9/2007
JP 2014141944 8/2014
JP 2016114004 6/2016
JP 2016217157 12/2016
JP 2017101580 6/2017
JP 2018061600 4/2018

* cited by examiner

IMPELLER AND CENTRIFUGAL PUMP

CROSS-REFERENCE TO RELATED APPLICATION

This application claims the priority benefit of Japan Application No. 2019-099370, filed on May 28, 2019. The entirety of the above-mentioned patent application is hereby incorporated by reference herein and made a part of this specification.

BACKGROUND

Technical Field

The disclosure relates to an impeller applied to a centrifugal pump, and a centrifugal pump. Particularly, the disclosure relates to an impeller and a centrifugal pump applied as an engine water pump.

Related Art

As a conventional centrifugal pump, there is known one which includes a housing having an inlet, an impeller chamber and an outlet, and an impeller disposed in the impeller chamber inside the housing and rotationally driven by a driving shaft, in which an open impeller having a hub plate (disk) having a connecting hole connecting the driving shaft, and a plurality of blades integrally formed on the hub plate, and being open toward the inlet is adopted as the impeller (see, for example, Patent Document 1, Patent Document 2, and Patent Document 3).

To provide a plurality of blades, this open impeller is based on the premise that one side of the blades is formed integrally and continuously on the hub plate disposed on a side connecting the driving shaft.

However, in the open impeller, since there are fears that the pressure between the hub plate and a back wall of the housing may drop and a bearing seal of the driving shaft or the like may be damaged, there is known an open impeller in which a through hole is provided on the hub plate so as to suppress the pressure drop on a back side of the hub plate (see, for example, Patent Document 4).

In addition, in the open impeller, a Rankine vortex (infinitely rotating vortex) and backflow occur on the inlet side where the pressure is low, particularly when the flow rate is low, and pump performance deteriorates.

To deal with this, there is known a closed impeller in which a disk-shaped shroud plate is attached to the inlet side to cover the other side of the blades (see, for example, Patent Document 5 and Patent Document 6).

However, in the closed impeller, a first member composed of a hub plate and a blade and a second member composed of a shroud plate or a shroud plate and a blade must be connected together. This increases the number of parts, the cost and the weight.

Also, since a gap between the shroud plate and an inner wall of the housing affects the pump performance, it is necessary to manage assembly of the shroud plate with high accuracy. This leads to complex assembly work and increased manufacturing cost.

Further, in the closed impeller, a fluid passage defined by a plurality of blades is closed by the hub plate and the shroud plate from both sides. Therefore, it is difficult to integrally mold the closed impeller by a mold or the like by using a resin material or a metal material.

PATENT DOCUMENTS

[Patent Document 1] Japanese Patent Laid-Open No. 2016-114004

[Patent Document 2] Japanese Patent Laid-Open No. 2016-217157

[Patent Document 3] Japanese Patent Laid-Open No. 2014-141944

[Patent Document 4] Japanese Patent Laid-Open No. 2006-307859

[Patent Document 5] Japanese Patent Laid-Open No. 2007-239731

[Patent Document 6] Japanese Patent Laid-Open No. 2018-61600

The disclosure provides an impeller and a centrifugal pump that can be simplified in structure and reduced in weight and cost and can be integrally molded by a mold or the like.

SUMMARY

An impeller of the disclosure is an impeller as follows. In a centrifugal pump including a housing having an inlet, an outlet and an impeller chamber, the impeller is disposed in the impeller chamber and is rotationally driven by a driving shaft. The impeller includes: a shaft part connected to the driving shaft to rotate about an axis line extending toward the inlet; a plurality of blades extending radially from an outer periphery of the shaft part; and an annular shroud plate continuous with the plurality of blades so as to cover a tip side area of the plurality of blades, to be disposed adjacent to an inner wall of the housing on the inlet side.

DESCRIPTION OF THE EMBODIMENTS

Hereinafter, one embodiment of the disclosure is described with reference to the accompanying drawings.

Figure 1:
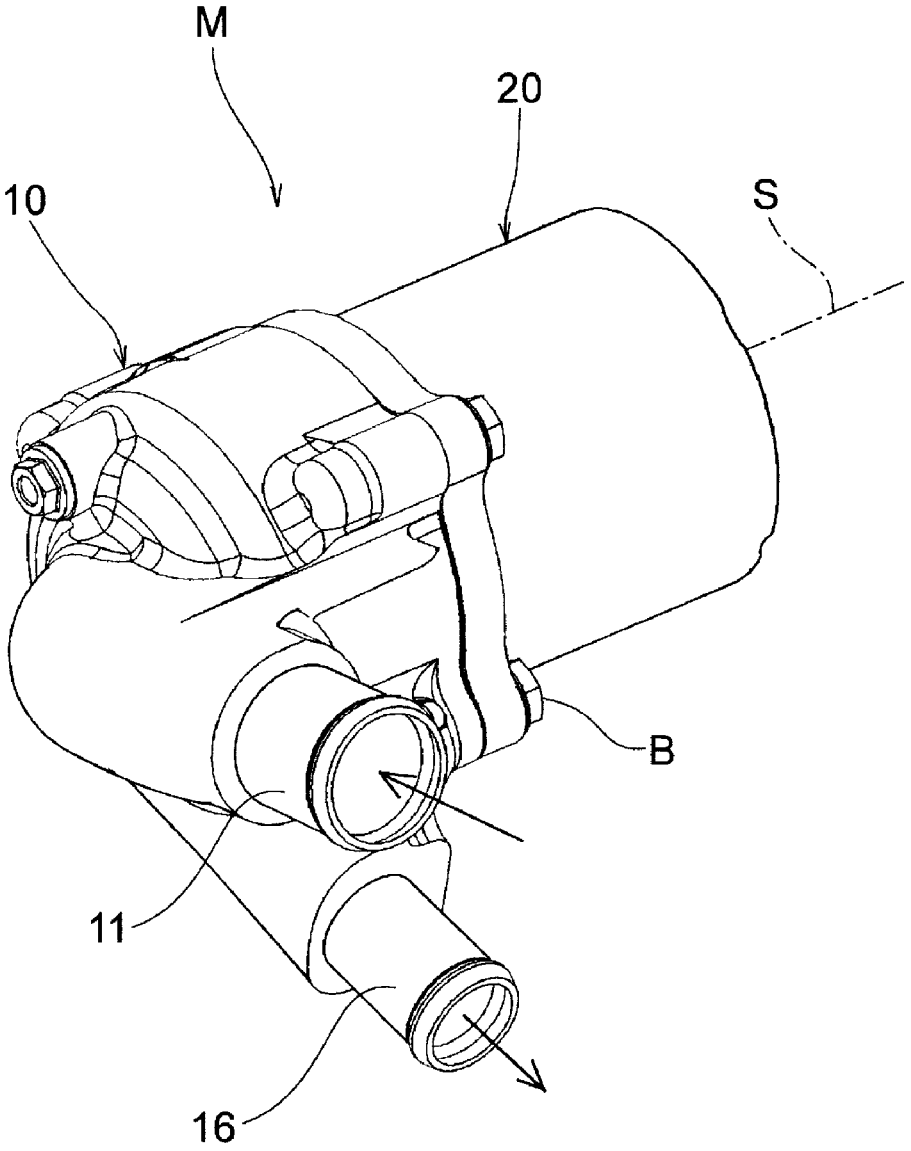
FIG. 1 is an appearance perspective view showing one embodiment of a centrifugal pump including an impeller according to the disclosure.
Figure 2:
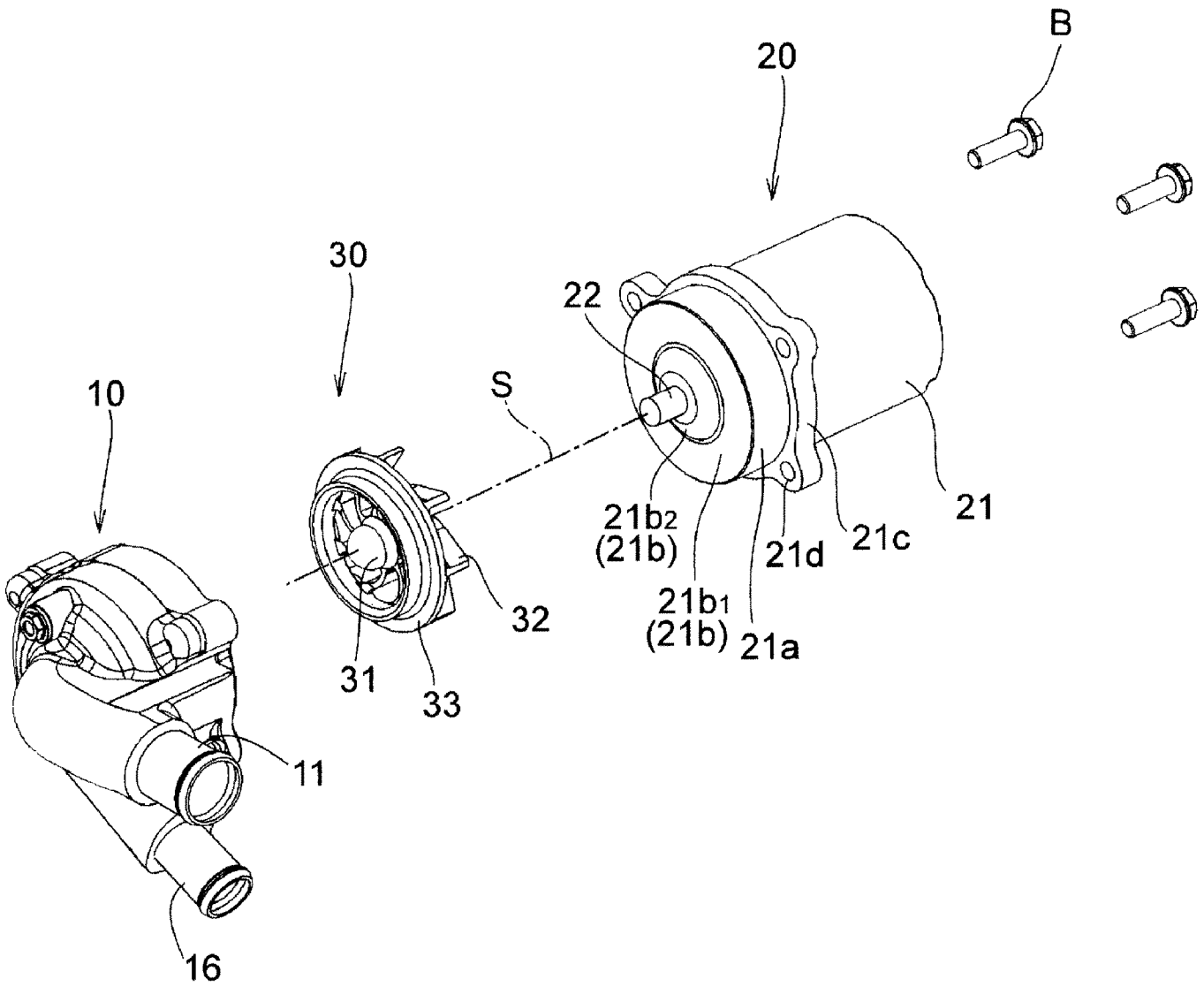
FIG. 2 is an exploded perspective view of the centrifugal pump shown in FIG. 1.
Figure 3:
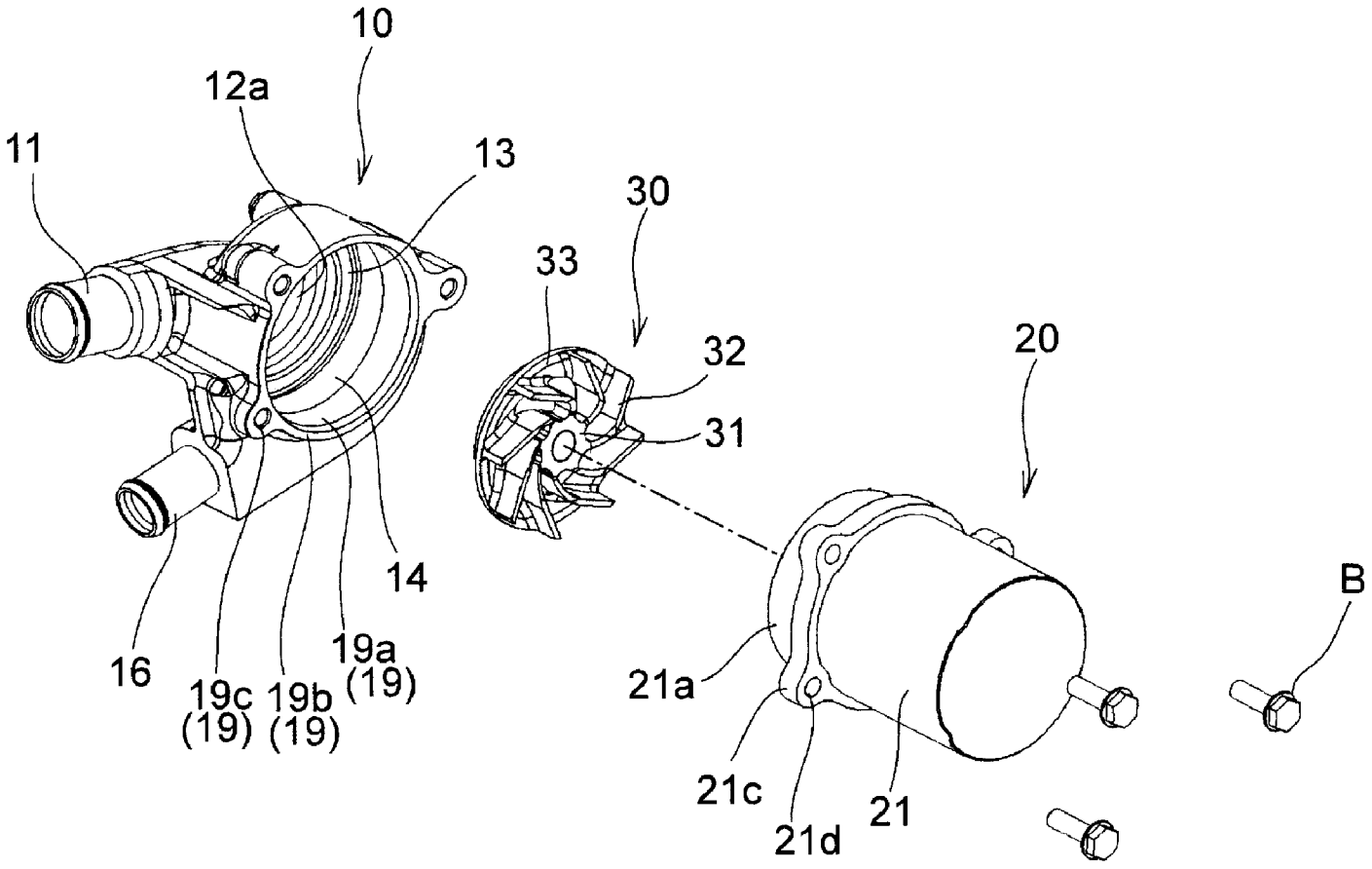
FIG. 3 is an exploded perspective view of the centrifugal pump shown in FIG. 2 as viewed from another angle.
Figure 4:
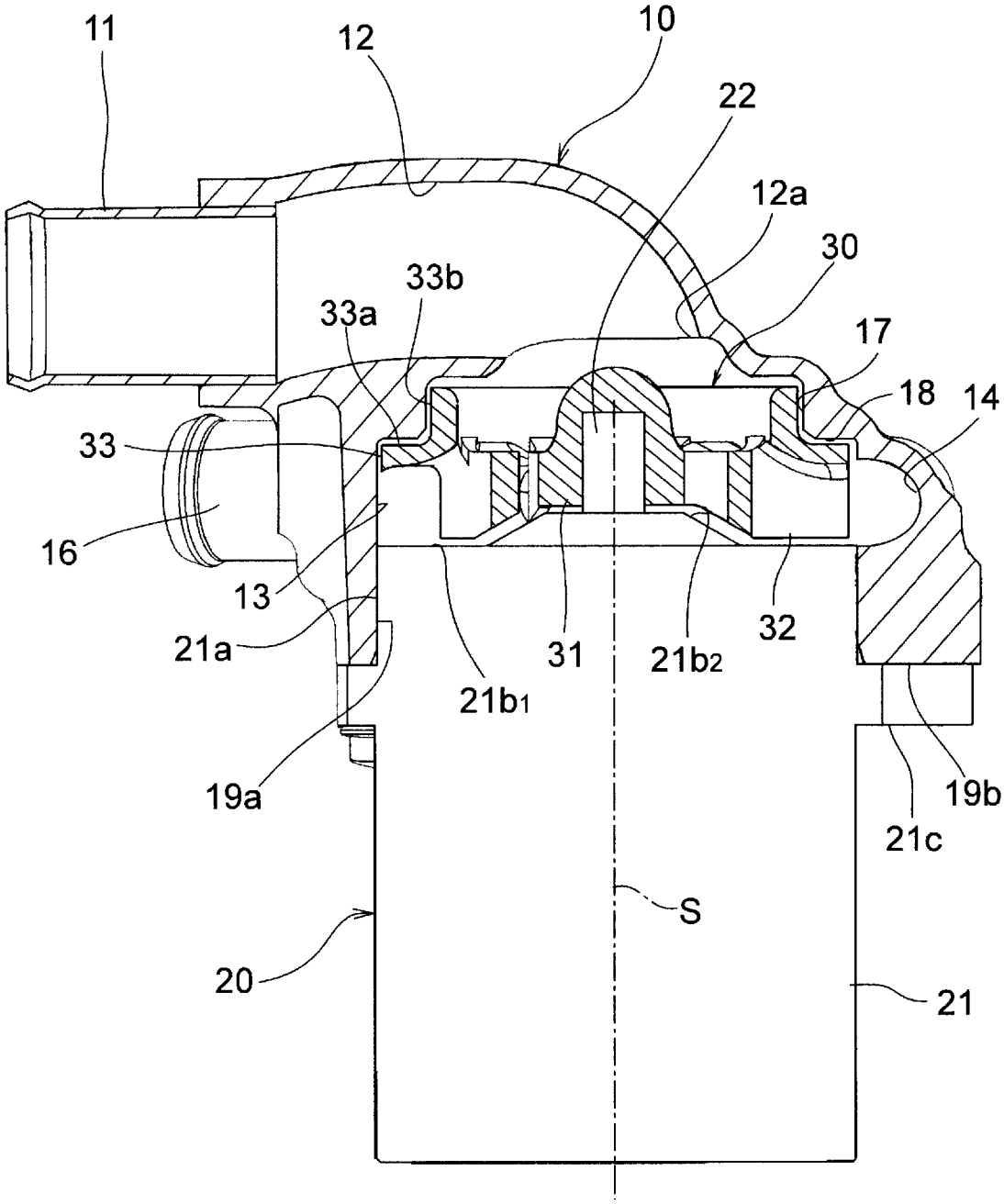
FIG. 4 is a cross-sectional view showing the inside of the centrifugal pump shown in FIG. 1.
Figure 5:
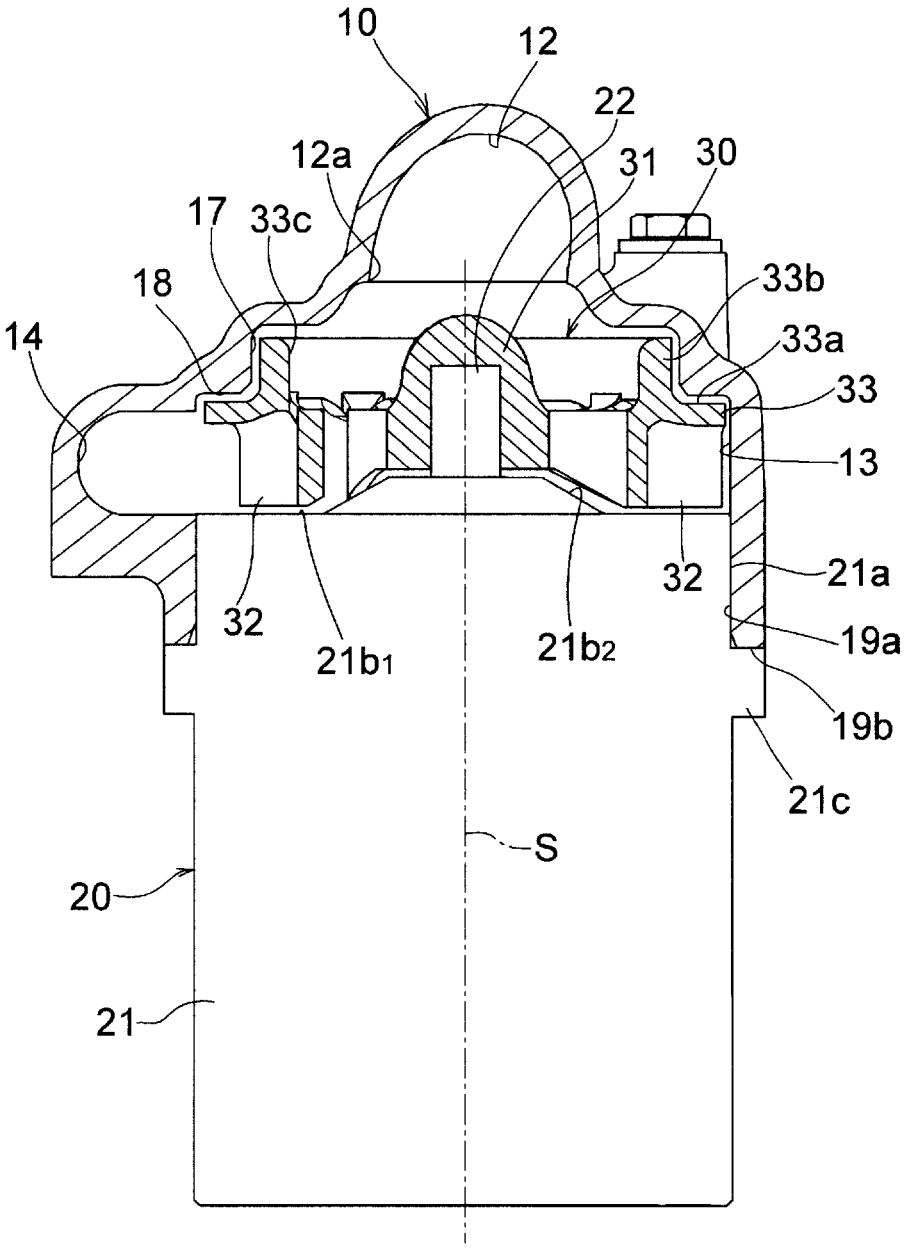
FIG. 5 is a cross-sectional view showing the inside of the centrifugal pump shown in FIG. 1.

A centrifugal pump M according to one embodiment is applied as a water pump transferring engine cooling water, for example, as a fluid. As shown in FIG. 1 to FIG. 3, the centrifugal pump M includes a housing 10, a driving source 20, and an impeller 30 rotating about an axis line S.

The housing 10 is formed of an aluminum material or the like, and includes, as shown in FIG. 3 to FIG. 6, a connector 11, an intake path 12, an impeller chamber 13, a volute chamber 14, a discharge path 15, a connector 16, an inner wall 17, an inner wall 18, and a motor attachment part 19.

The connector 11 is formed of a metal pipe for a piping that guides the fluid to be transferred to be connected thereto.

The intake path 12 is an area into which the fluid flows toward the impeller chamber 13, and the intake path 12 defines an inlet 12*a* on a downstream side facing the impeller chamber 13.

The inlet 12*a* has a substantially circular cross section centered on the axis line S.

In addition, at the inlet 12*a*, the intake path 12 directs the fluid to flow in the direction of the axis line S.

The impeller chamber 13 is formed as a space having a predetermined gap with an outer contour of the impeller 30 and defined by an inner peripheral wall centered on the axis line S, in order to accommodate the impeller 30 so that the impeller 30 is rotatable about the axis line S.

Here, a casing 21 of the driving source 20 fitted to the motor attachment part 19 may define a part of the impeller chamber on a back side of the impeller 30.

The volute chamber 14 extends in a vortex shape about the axis line S, and is formed so as to communicate an outer peripheral area of the impeller chamber 13 with the discharge path 15.

Figure 6:
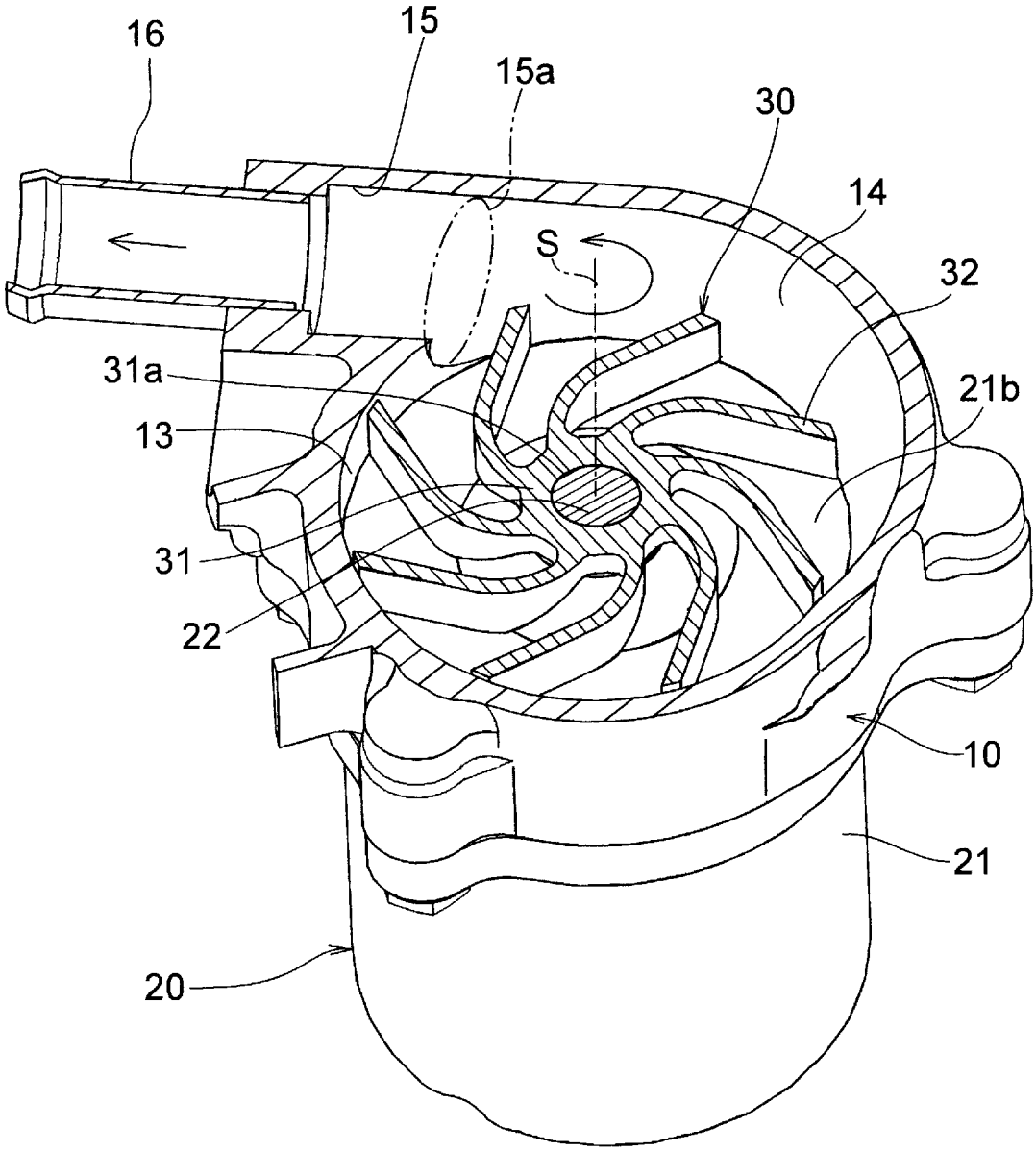
FIG. 6 is a perspective cross-sectional view showing the inside of the centrifugal pump shown in FIG. 1.
Figure 7:
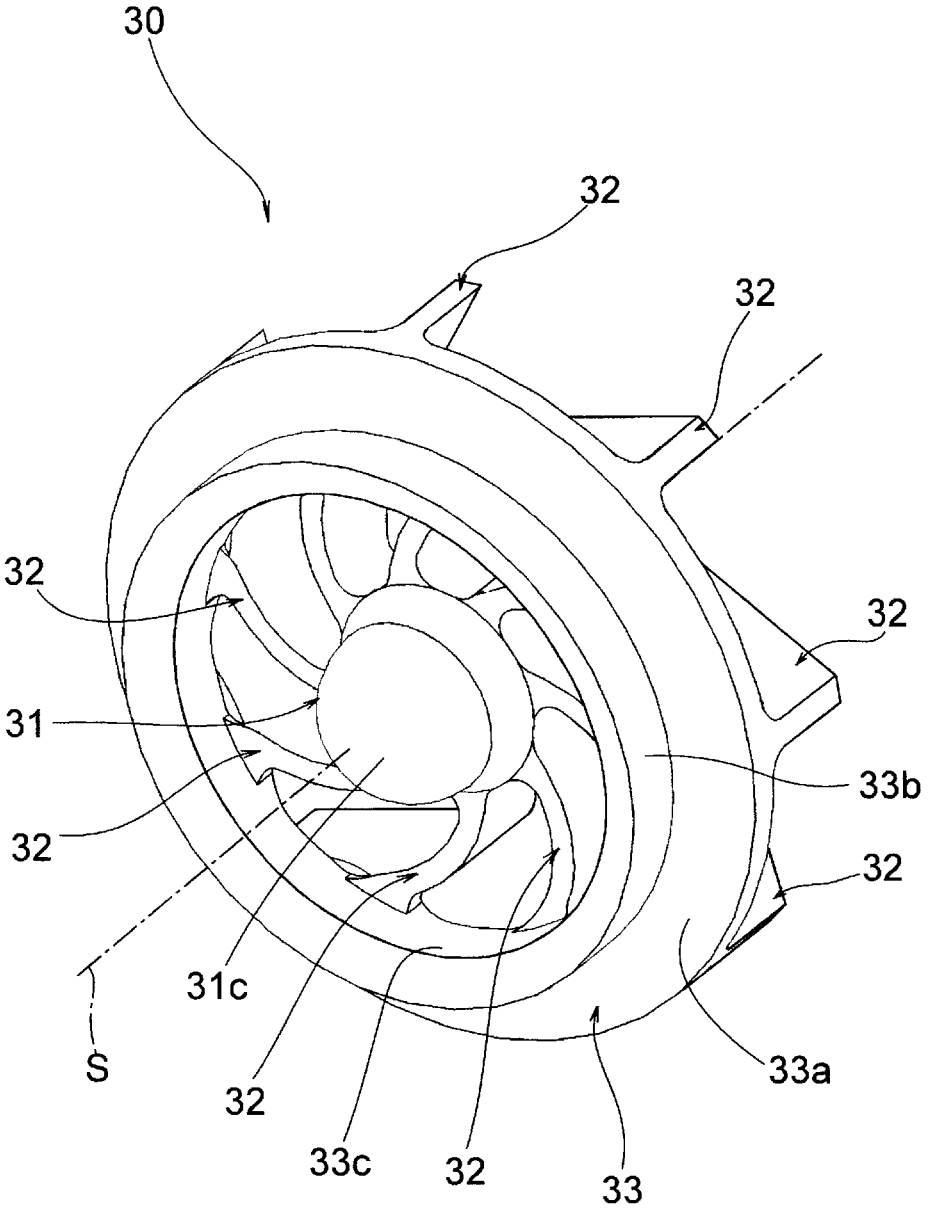
FIG. 7 shows one embodiment of an impeller according to the disclosure, and is a perspective view as viewed from an inlet side.
Figure 8:
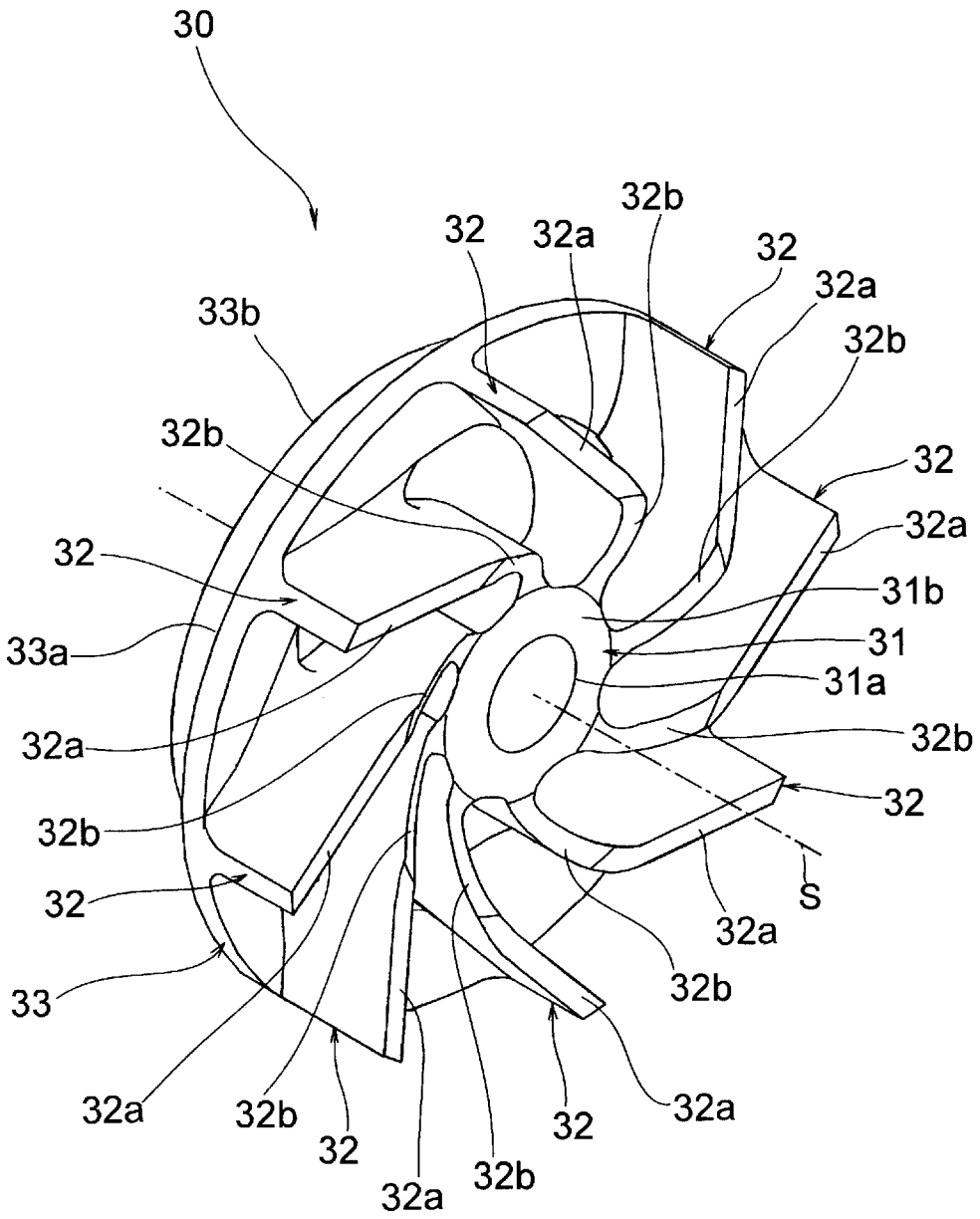
FIG. 8 is a perspective view of the impeller shown in FIG. 7 as viewed from a back side opposite the inlet.

As shown in FIG. 6, the discharge path 15 is an area guiding the fluid that has flowed out of the impeller chamber 13 and passed through the volute chamber 14 to the downstream side, and defines an outlet 15*a* in a boundary area with the volute chamber 14.

The discharge path 15 is directed to rotate about the axis line S by the impeller 30, and directs the fluid that has passed through the volute chamber 14 in a direction perpendicular to the axis line S.

The connector 16 is formed of a metal pipe for a piping that transfers the fluid discharged from the discharge path 15 to be connected thereto.

The inner wall 17 forms a cylindrical wall centered on the axis line S in the vicinity of the inlet 12*a* to face a cylindrical part 33*b* of a shroud plate 33 of the impeller 30 with a small gap therebetween in a radial direction perpendicular to the axis line S.

The inner wall 18 is continuous with the inner wall 17 and forms an annular flat surface centered on the axis line S on a plane perpendicular to the axis line S to face an annular disk part 33*a* of the shroud plate 33 of the impeller 30 with a small gap therebetween in the direction of the axis line S.

The motor attachment part 19 is a portion to which the casing 21 of the driving source 20 is fitted and fixed, and the motor attachment part 19 includes a fitting hole 19*a*, a joint surface 19*b*, and a screw hole 19*c*.

The fitting hole 19*a* has a cylindrical shape centered on the axis line S for a fitting part 21*a* of the casing 21 to be fitted thereto.

The joint surface 19*b* forms an annular flat surface perpendicular to the axis line S for a flange part 21*c* of the casing 21 to be joined thereto.

The screw hole 19*c* is provided in three places on the joint surface 19*b* for a screw B to be screwed thereinto.

The driving source 20 is an electric motor, and includes the casing 21, a driving shaft 22 protruding from the casing 21, and rotors and coils that are accommodated in the casing 21 and exert a rotational driving force on the driving shaft 22.

The casing 21 is formed of a metal material such as aluminum, steel or the like, and includes, as shown in FIG. 2 and FIG. 3, the fitting part 21*a*, an end wall 21*b* defining a part of the impeller chamber, the flange part 21*c*, and a circular hole 21*d*.

The fitting part 21*a* forms a cylindrical surface centered on the axis line S to be closely fitted to the fitting hole 19*a* of the housing 10 with sealing performance being ensured.

To interpose a sealing member such as an O-ring or the like between the fitting part 21*a* and the fitting hole 19*a*, an annular groove into which the O-ring is fitted may be provided around the fitting part 21*a*.

The end wall 21*b* is formed in a circular shape centered on the axis line S, and defines an annular flat surface $\mathbf{21}b_1$ in an outer area and a protruding surface $\mathbf{21}b_2$ in a central area. The protruding surface $\mathbf{21}b_2$ is formed in a truncated cone shape protruding toward the impeller 30.

In a state in which the casing 21 is fixed to the housing 10, the end wall 21*b* defines a back wall facing the back surface of the impeller 30 disposed in the impeller chamber 13 of the housing 10.

That is, the flat surface $\mathbf{21}b_1$ faces a tip side area of the plurality of blades 32 of the impeller 30 with a small gap therebetween in the direction of the axis line S; the protruding surface $\mathbf{21}b_2$ faces a base side area of the plurality of blades 32 of the impeller 30 and a back surface 31*b* of the shaft part 31 with a small gap therebetween in the direction of the axis line S.

The flange part 21*c* is formed so as to include an annular flat surface in order to be in close contact with the joint surface 19*b* of the housing 10.

The circular hole 21*d* is formed in three places on the flange part 21*c* for the screw B screwed into the three screw holes 19*c* of the housing 10 to pass therethrough.

As shown in FIG. 2, the driving shaft 22 protrudes from the end wall 21*b* of the casing 21 and is formed in a columnar shape extending in the direction of the axis line S.

As shown in FIG. 6, the driving shaft 22 is fitted to a fitting hole 31*a* of the impeller 30 and integrally rotates the impeller 30 about the axis line S.

While shown in a columnar shape, the driving shaft 22 may have a rectangular cross section having a width across flat or have other shape other than circular in cross-section.

The impeller 30 is integrally molded by a mold by using a metal material such as aluminum or a resin material, and includes, as shown in FIG. 7 to FIG. 12, the shaft part 31, the plurality of (here eight) blades 32, and the shroud plate 33.

The shaft part 31 is formed in a substantially columnar shape centered on the axis line S extending toward the inlet 12*a*, and includes the fitting hole 31*a*, the back surface 31*b*, and a tip part 31*c*.

The fitting hole 31*a* is formed in a cylindrical shape for the driving shaft 22 to be fitted thereto. If the driving shaft 22 is integrally fixed, the fitting hole 31*a* may have, for example, a rectangular cross section or have other hole shape other than circular in cross-section, in accordance with the shape of the driving shaft 22.

The back surface 31*b* is formed as an annular flat surface centered on the axis line S, and faces the central area of the protruding surface 21$b_2$ of the end wall 21*b* of the casing 21.

The tip part 31*c* is formed so as to form, at a tip toward the inlet 12*a*, a hemispherical end part protruding from the plurality of blades 32 toward the inlet 12*a*.

The tip part 31*c* serves to guide the fluid flowing from the inlet 12*a* radially about the axis line S toward the plurality of blades 32. Here, since the tip part 31*c* is formed in a hemispherical shape, the fluid can be efficiently directed toward the blades 32 while loss of fluid due to collision can be reduced.

The blades 32 all have the same shape, and are formed integrally with the shaft part 31 so as to extend as being radially outward from the outer periphery at equal intervals in a circumferential direction of the shaft part 31.

Figure 9:
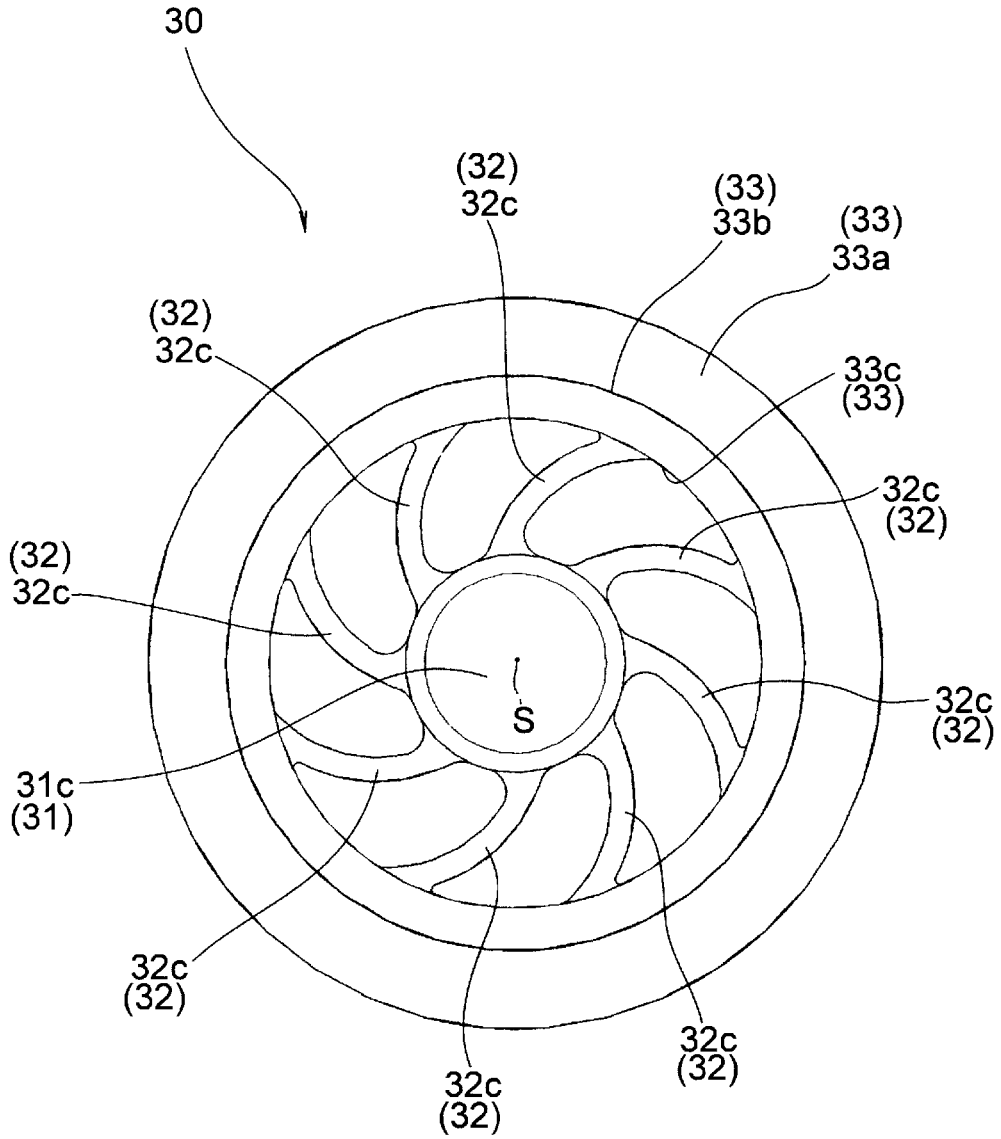
FIG. 9 is a front view of the impeller shown in FIG. 7 as viewed from the inlet side.
Figure 10:
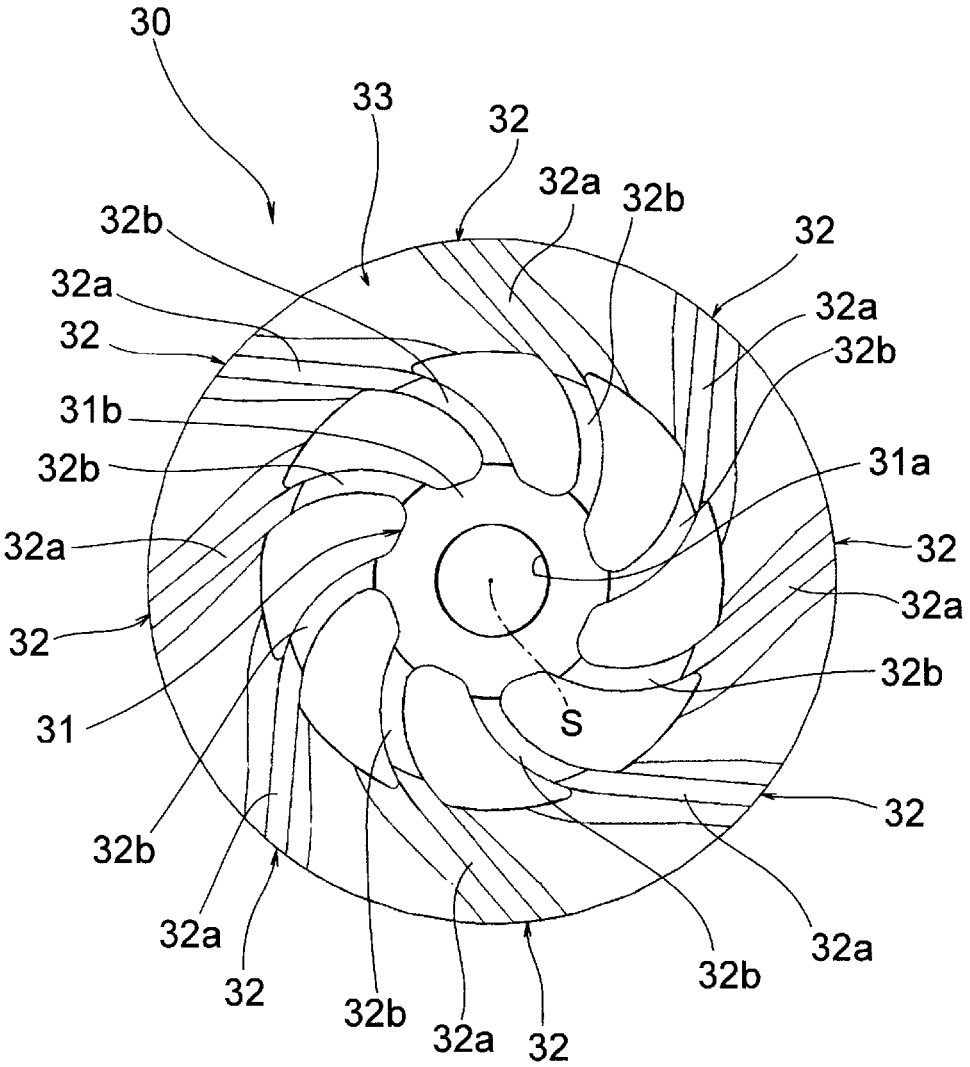
FIG. 10 is a back view of the impeller shown in FIG. 7 as viewed from the back side opposite the inlet.
Figure 11:
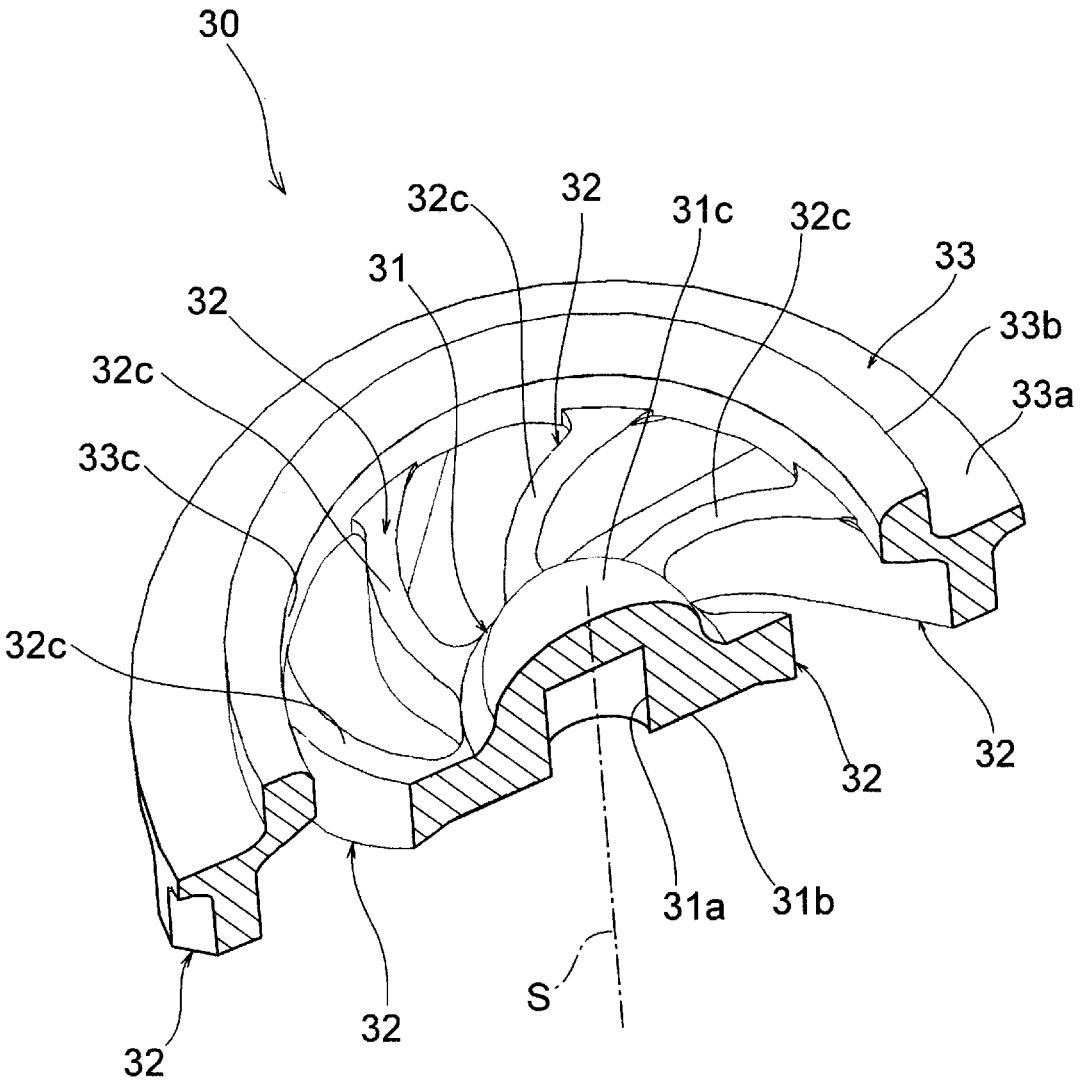
FIG. 11 is a perspective cross-sectional view of the impeller shown in FIG. 7 cut along a plane passing through an axis line of a shaft part.
Figure 12:
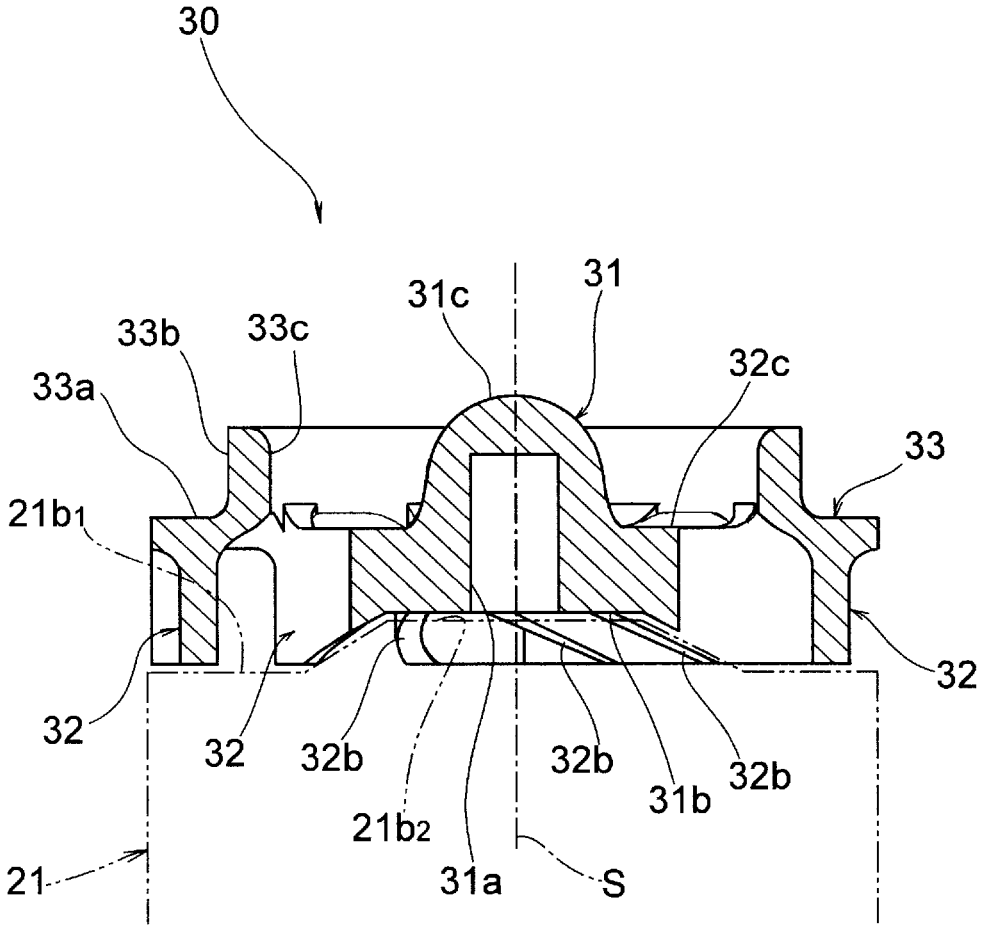
FIG. 12 is a cross-sectional view of the impeller shown in FIG. 7 cut along a plane passing through the axis line of the shaft part.
Figure 13:
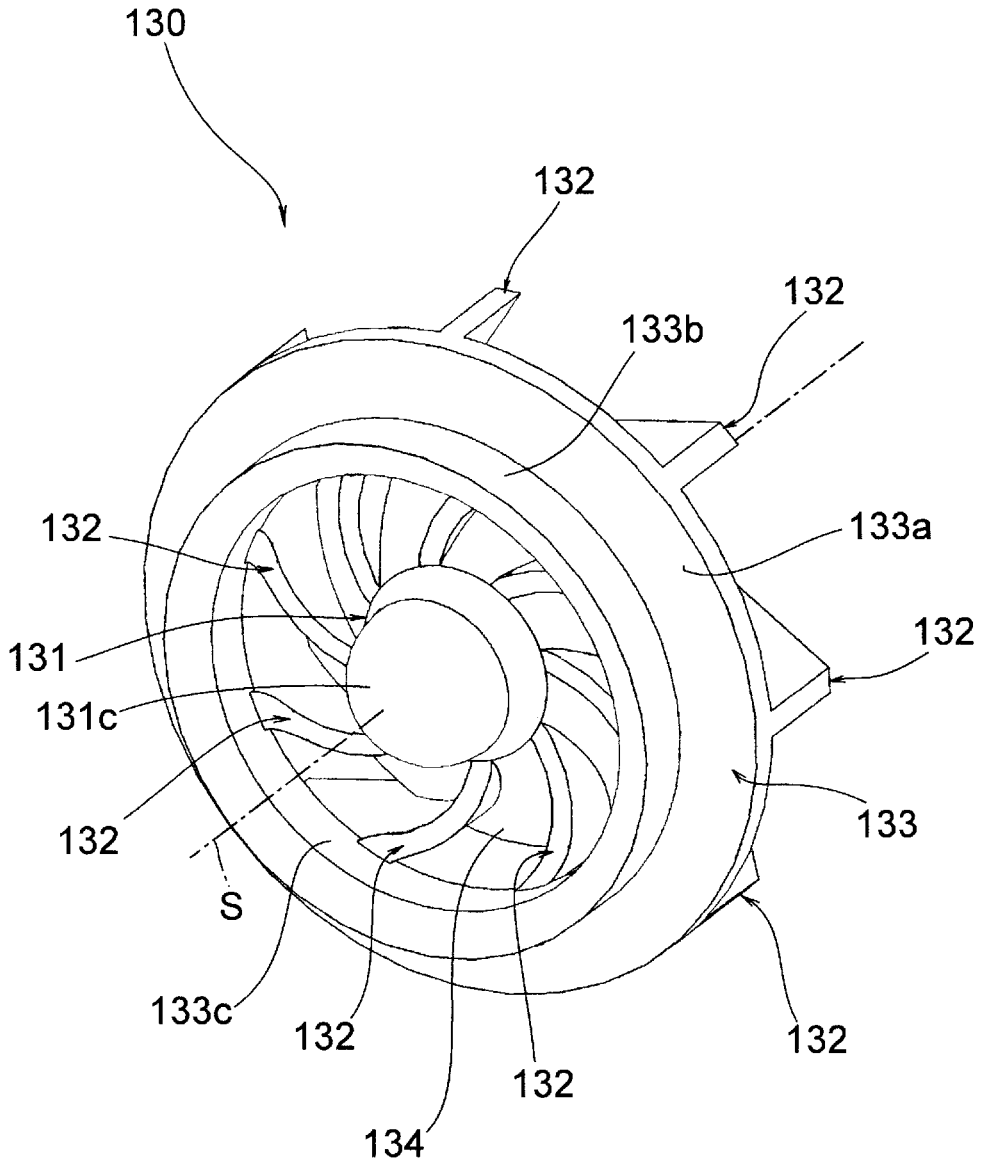
FIG. 13 shows another embodiment of the impeller according to the disclosure, and is a perspective view as viewed from the inlet side.
Figure 14:
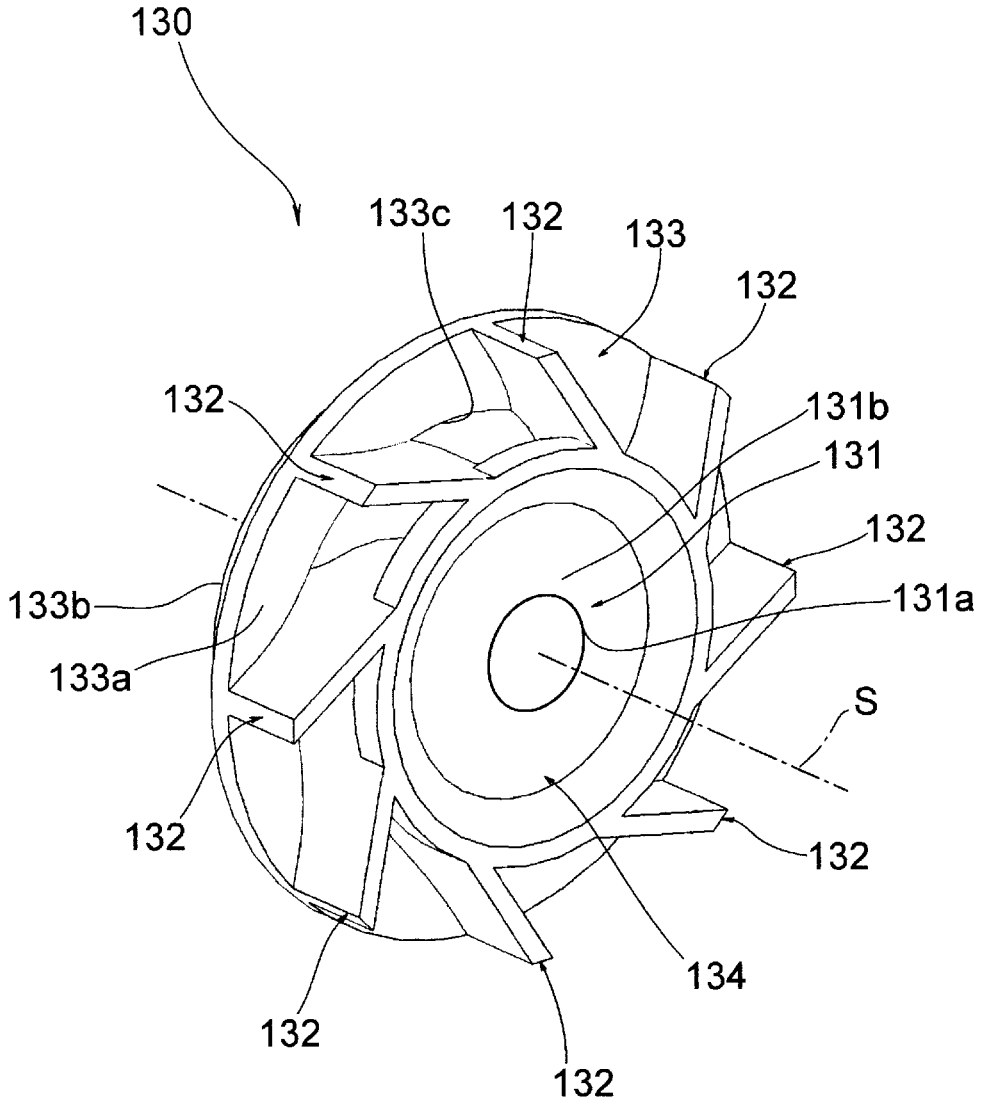
FIG. 14 is a perspective view of the impeller shown in FIG. 13 as viewed from a back side opposite the inlet.

The blades 32 have a thin plate shape extending in the direction of the axis line S, and are formed so as to bend as being radially outward from the shaft part 31 when viewed from the direction of the axis line S, as shown in FIG. 9 and FIG. 10.

In addition, the blades 32 have, on a side opposite the side where the shroud plate 33 is disposed in the direction of the axis line S, a contour along the end wall 21*b* of the casing 21 with a predetermined gap therebetween, that is, along an inner wall of the impeller chamber.

Specifically, the blades 32 include a flat surface 32*a* facing the flat surface 21$b_1$ of the end wall 21*b* and an inclined surface 32*b* facing a conical surface of the protruding surface 21$b_2$ of the end wall 21*b*.

The inclined surface 32*b* is an area in the blades 32 that has a contour whose width in the direction of the axis line S increases as being radially away from the shaft part 31.

Further, in the blades 32, an end face 32*c* facing the side where the shroud plate 33 is disposed, that is, the inlet 12*a* side, is formed as a substantially flat surface located on a plane perpendicular to the axis line S in the direction of the axis line S.

The shroud plate 33 has an annular shape centered on the axis line S, is formed continuously and integrally with the plurality of blades 32 so as to cover the tip side area of the plurality of blades 32, and includes the annular disk part 33*a* and the cylindrical part 33*b* extending from an inner edge area of the annular disk part 33*a* in the direction of the axis line S.

The annular disk part 33*a* is formed as a flat surface extending on a plane perpendicular to the axis line S, and is disposed adjacent to the inner wall 18 on the inlet 12*a* side of the housing 10, that is, apart from the inner wall 18 with a small gap therebetween in the direction of the axis line S.

The cylindrical part 33*b* defines an outer peripheral surface centered on the axis line S, and is disposed adjacent to the inner wall 17 of the housing 10 on the inlet 12*a* side, that is, apart from the inner wall 17 with a small gap therebetween in the direction perpendicular to the axis line S.

The shroud plate 33 defines, inside the cylindrical part 33*b*, a circular opening part 33*c* into which a fluid flows.

According to the impeller 30 having the above configuration, there is no conventional hub plate, and only the shaft part 31, the plurality of blades 32 extending from the outer periphery of the shaft part 31, and the shroud plate 33 covering the tip side area of the plurality of blades 32 on the inlet 12*a* side are included.

Therefore, the following effects can be obtained. Since there is no conventional hub plate, problems such as deterioration of sealing performance around the driving shaft due to a pressure drop on the back side of the hub plate, which has occurred in a conventional impeller, are solved.

Also, since there is no hub plate, the structure can be simplified, the weight can be reduced, the moment of inertia can be reduced, the friction loss between the hub plate and the fluid can be reduced, and the responsiveness can be improved.

A relative speed of a fluid flowing between the plurality of blades 32 with respect to the inner wall (end wall 21*b*) of the impeller chamber 13 is less than in a conventional example in which the hub plate is provided. Therefore, the friction loss of the fluid can be reduced.

Since the shroud plate 33 is disposed on the inlet 12*a* side where the pressure is low, the occurrence of the Rankine vortex (infinitely rotating vortex) can be prevented or suppressed.

Since the shroud plate 33 faces the inner walls 17 and 18 of the housing 10 with a small gap therebetween, leakage of the fluid caused by backflow from the outlet 15*a* side where the pressure is high to the inlet 12*a* side where the pressure is low can be prevented. That is, by disposing the shroud plate 33 on the inlet 12*a* side, deterioration of pump efficiency can be prevented.

When the impeller 30 is molded by a mold or the like, since the mold can be separated in the direction of the axis line S, the impeller 30 can be easily integrally molded using a metal material or a resin material.

Since the shroud plate 33 is molded integrally with the shaft part 31 and the plurality of blades 32, conventional assembly work is unnecessary, and there is no need to manage the assembly with high accuracy, and the manufacturing cost can be reduced.

Here, assembly of the centrifugal pump M is described.

At the time of assembly, the housing 10, the driving source 20, the impeller 30, and the screw B are prepared.

First, the impeller 30 is fitted and fixed to the driving shaft 22 of the driving source 20 so that the impeller 30 can rotate integrally with the driving shaft 22.

Subsequently, the casing 21 of the driving source 20 is fitted to the motor attachment part 19 of the housing 10 so that the impeller 30 can be accommodated in the impeller chamber 13.

Subsequently, the screw B is screwed into the screw hole 19*c* of the housing 10 through the circular hole 21*d* of the casing 21, and the casing 21 is fastened to the housing 10. Thereby, the assembly of the centrifugal pump M is completed.

Next, an operation when the centrifugal pump M is applied to an engine cooling water circulation system is described.

In this case, in the centrifugal pump M, the housing 10 is fixed to an engine by a bolt or the like (not shown) via a mounting boss (not shown), the connector 11 is connected to a piping on a supply side from the engine, and the connector 16 is connected to a piping on a transfer destination side of the engine.

The driving source 20 is driven by a control unit of the engine, the driving shaft 22 rotates as shown by an arrow in FIG. 6, and the impeller 30 rotates integrally with the driving shaft 22.

Then, the cooling water flows through the intake path 12, and is guided from the inlet 12*a* via the opening part 33*c* to a passage inside the impeller 30 that is disposed in the impeller chamber 13.

Then, the cooling water flowing in from the direction of the axis line S receives a centrifugal force along the blades 32 of the impeller 30 and is transferred while its direction of flow is changed to the direction perpendicular to the axis line S.

At the time of this change of direction, since the cooling water flows smoothly along the end wall 21*b* of the casing 21, that is, along the flat surface 21$b_1$ from the conical inclined surface of the protruding surface 21$b_2$, collision loss or passage loss or the like can be reduced.

Subsequently, the pressurized cooling water flows through the discharge path 15 via the volute chamber 14 and the outlet 15*a*, passes through the piping connected to the connector 16, and is transferred to the transfer destination on the downstream side of the engine.

In the above transfer operation, the impeller 30 can efficiently discharge the cooling water while preventing or suppressing the occurrence of the Rankine vortex on the inlet 12*a* side by the shroud plate 33.

Also, since the impeller 30 is reduced in weight, a load as the driving source 20 is also reduced, and power consumption of the electric motor as the driving source 20 can be reduced.

As described above, according to the impeller 30 and the centrifugal pump M having the above configurations, the structure can be simplified, the weight and cost can be reduced, and the impeller 30 can be integrally molded by a mold or the like.

FIG. 13 to FIG. 18 show another embodiment of the impeller according to the disclosure, which can replace the impeller 30 in the aforesaid centrifugal pump M.

An impeller 130 according to this embodiment is integrally molded by a mold by using a metal material such as aluminum or a resin material, and includes integrally a shaft part 131, a plurality of (here eight) blades 132, a shroud plate 133 and a disk part 134.

The shaft part 131 is formed in a substantially columnar shape centered on the axis line S extending toward the inlet 12*a*, and includes a fitting hole 131*a*, a back surface 131*b*, and a tip part 131*c*.

The fitting hole 131*a* is formed in a cylindrical shape for the driving shaft 22 to be fitted thereto. If the driving shaft 22 is integrally fixed, the fitting hole 131*a* may have, for example, a rectangular cross section or have other hole shape other than circular in cross-section, in accordance with the shape of the driving shaft 22.

The back surface 131*b* is formed as an annular flat surface centered on the axis line S, and faces the central area of the protruding surface 21$b_2$ of the end wall 21*b* of the casing 21.

The tip part 131*c* is formed so as to form, at the tip toward the inlet 12*a*, a hemispherical end part protruding from the plurality of blades 132 toward the inlet 12*a*.

The tip part 131*c* serves to guide the fluid flowing from the inlet 12*a* radially about the axis line S toward the plurality of blades 132.

Here, since the tip part 131*c* is formed in a hemispherical shape, the fluid can be efficiently directed toward the blades 132 while loss of fluid due to collision can be reduced.

The blades 132 all have the same shape, and are formed integrally with the shaft part 131 so as to extend as being radially outward from the outer periphery at equal intervals in a circumferential direction of the shaft part 131.

Figure 15:
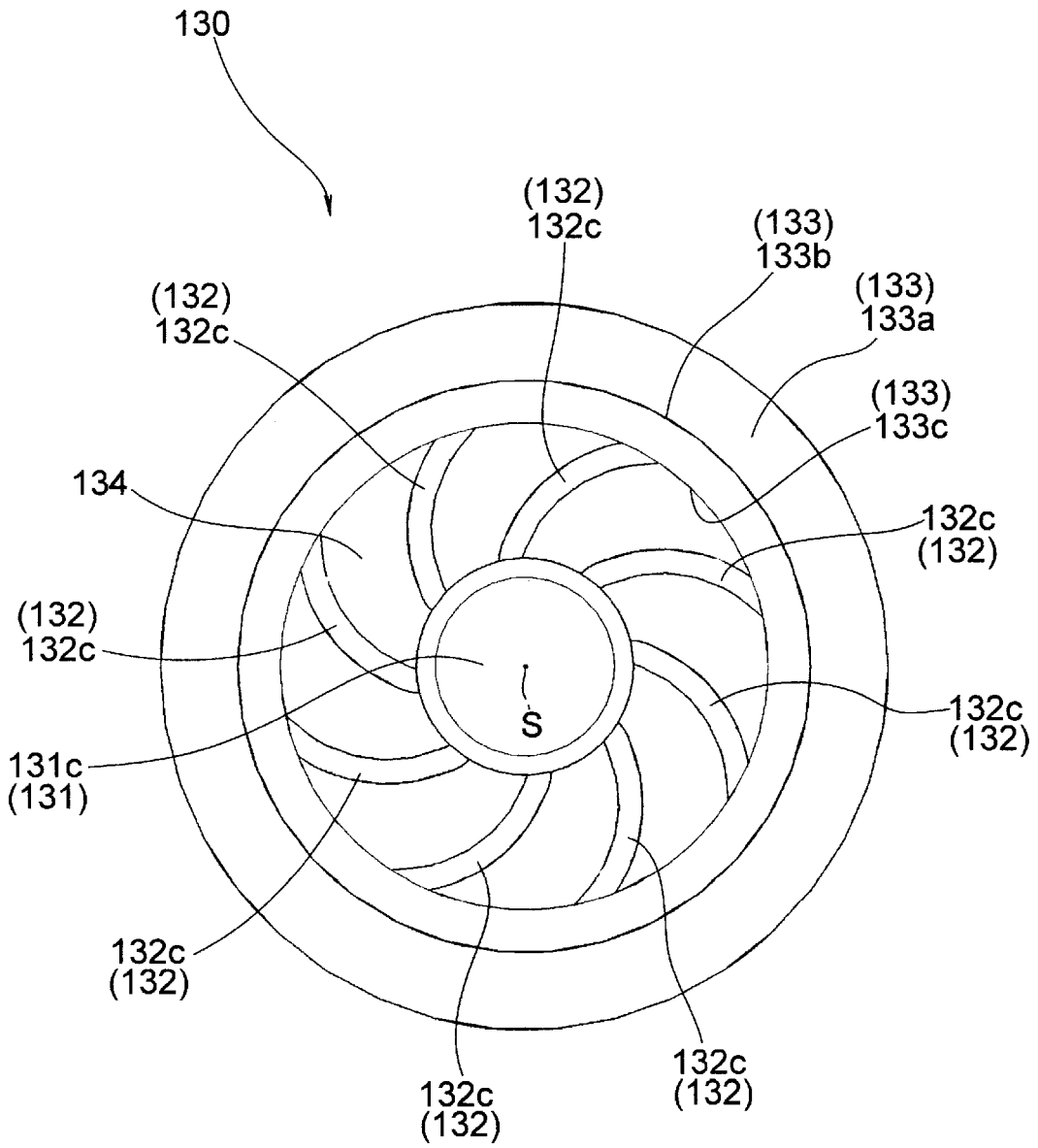
FIG. 15 is a front view of the impeller shown in FIG. 13 as viewed from the inlet side.
Figure 16:
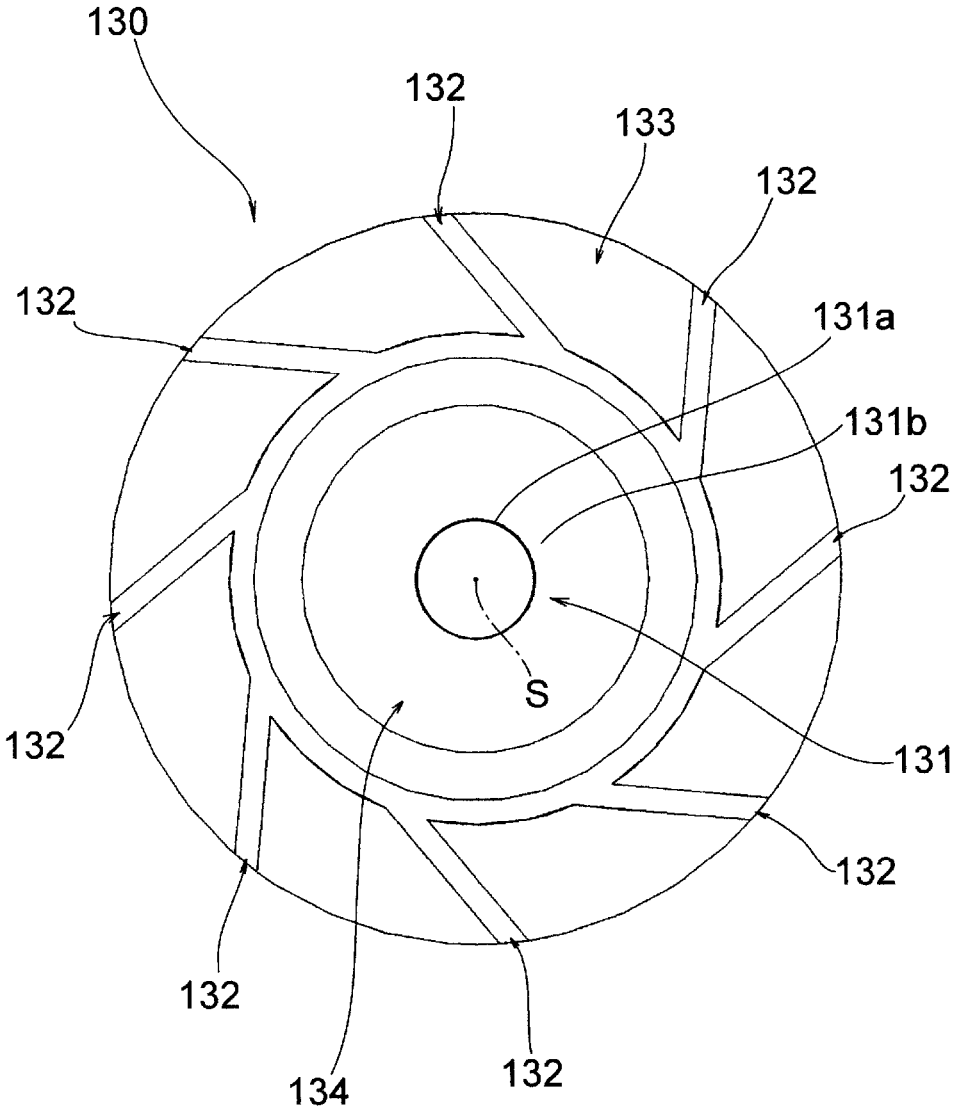
FIG. 16 is a back view of the impeller shown in FIG. 13 as viewed from the back side opposite the inlet.

The blades 132 have a thin plate shape extending in the direction of the axis line S, and are formed so as to bend as being radially outward from the shaft part 131 when viewed from the direction of the axis line S, as shown in FIG. 15 and FIG. 16.

Figure 17:
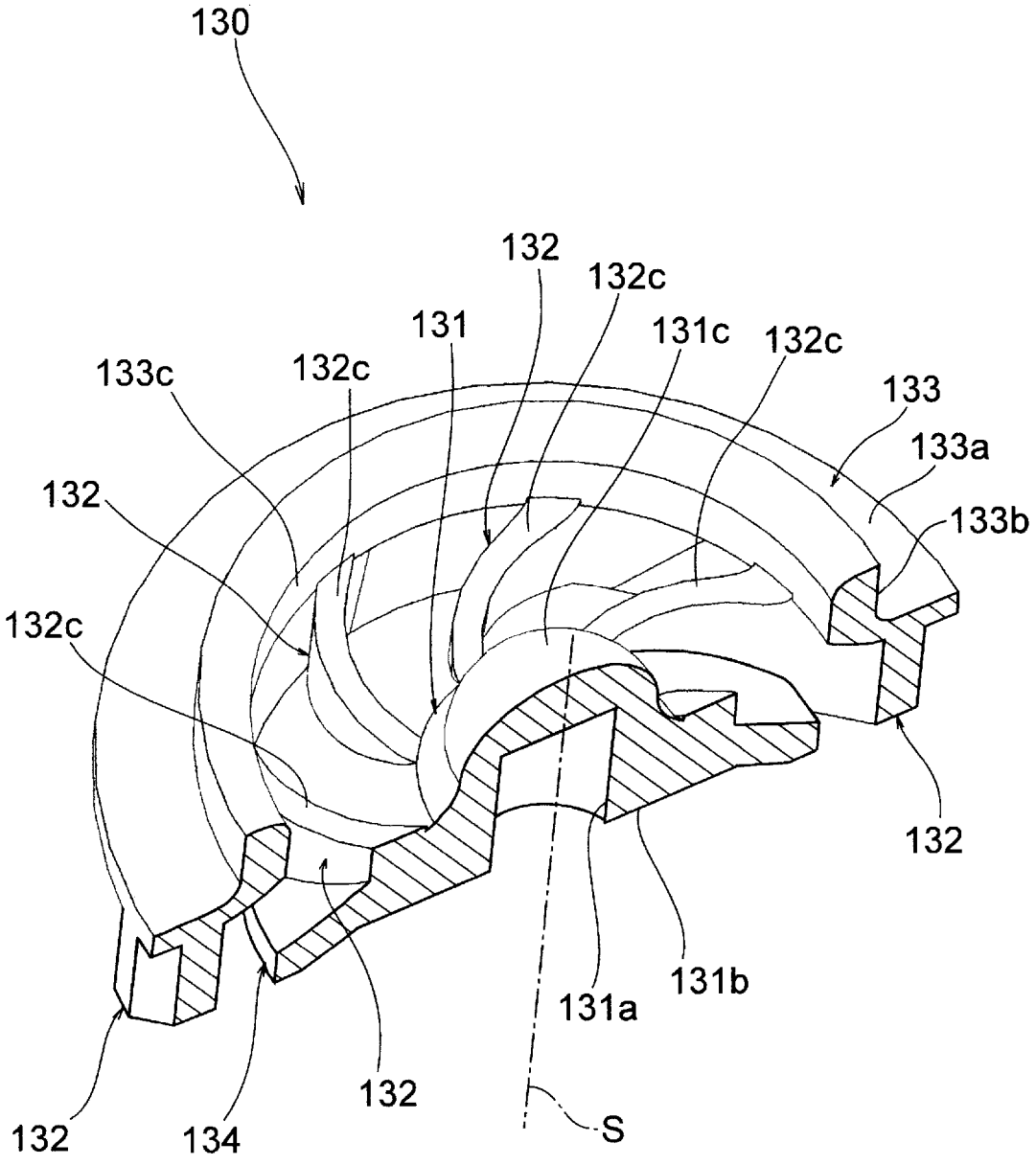
FIG. 17 is a perspective cross-sectional view of the impeller shown in FIG. 13 cut along a plane passing through an axis line of a shaft part.

As shown in FIG. 17, the blades 132 have a contour whose width in the direction of the axis line S increases as being radially away from the shaft part 131.

Further, in the blades 132, an end face 132*c* facing the side where the shroud plate 133 is disposed, that is, the inlet 12*a* side, is formed as a substantially flat surface located on a plane perpendicular to the axis line S in the direction of the axis line S.

The shroud plate 133 has an annular shape centered on the axis line S, and is formed continuously and integrally with the plurality of blades 132 so as to cover a tip side area of the plurality of blades 132.

The shroud plate 133 includes an annular disk part 133*a* and a cylindrical part 133*b* extending from an inner edge area of the annular disk part 133*a* in the direction of the axis line S.

The annular disk part 133*a* is formed as a flat surface extending on a plane perpendicular to the axis line S, and is disposed adjacent to the inner wall 18 on the inlet 12*a* side of the housing 10, that is, apart from the inner wall 18 with a small gap therebetween in the direction of the axis line S.

The cylindrical part 133*b* defines an outer peripheral surface centered on the axis line S, and is disposed adjacent to the inner wall 17 of the housing 10 on the inlet 12*a* side, that is, apart from the inner wall 17 with a small gap therebetween in the direction perpendicular to the axis line S.

The shroud plate 133 defines, inside the cylindrical part 133*b*, a circular opening part 133*c* into which a fluid flows.

As shown in FIG. 14 and FIG. 16 to FIG. 18, on the side opposite the side where the shroud plate 133 is disposed in the direction of the axis line S, the disk part 134 extends radially from the shaft part 131 and is continuously formed on the plurality of blades 132 so as to cover a base side area of the plurality of blades 132.

Figure 18:
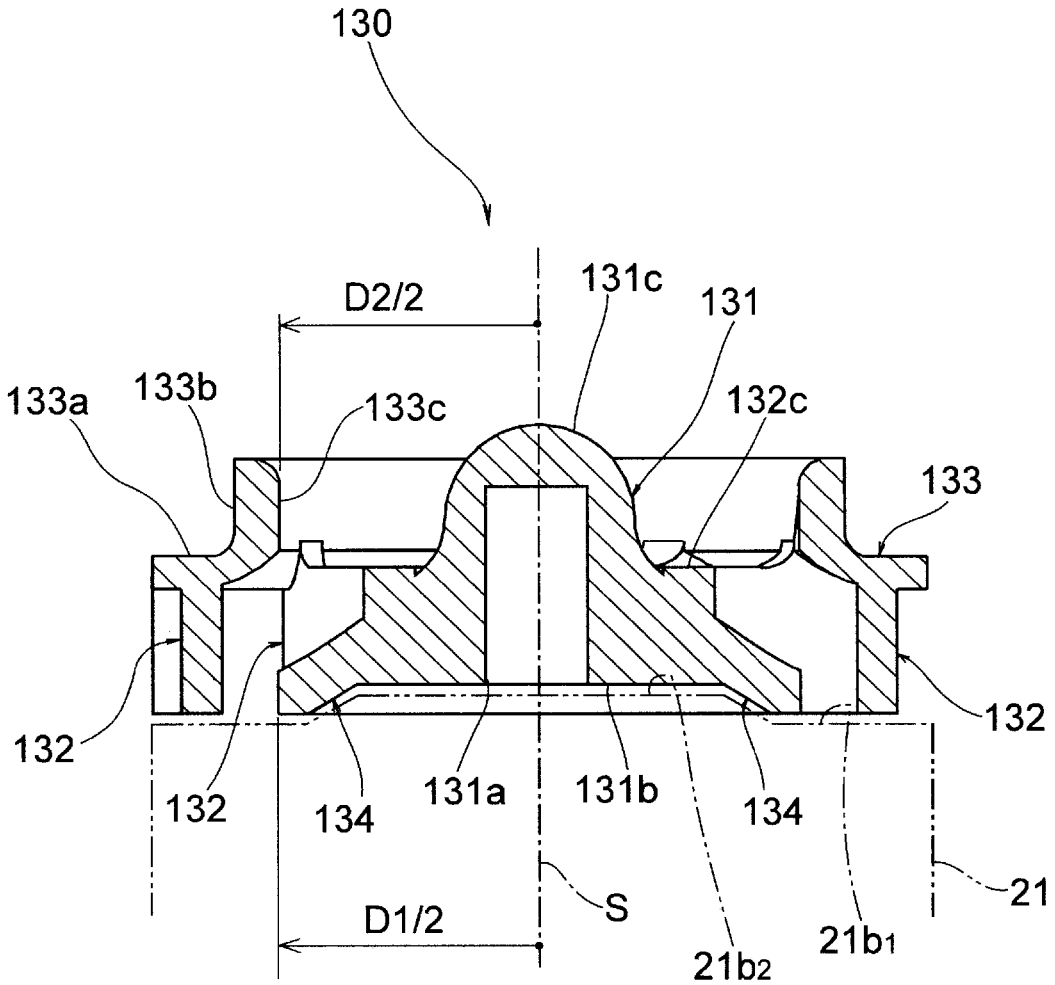
FIG. 18 is a cross-sectional view of the impeller shown in FIG. 13 cut along a plane passing through the axis line of the shaft part.

As shown in FIG. 18, the disk part 134 is formed so that an outer diameter dimension D1 is equal to or less than an inner diameter dimension D2 of the opening part 133*c* defined by the shroud plate 133.

In addition, the disk part 134 has, on a back side in the direction of the axis line S, a contour along the end wall 21*b* of the casing 21 with a predetermined gap therebetween, that is, along an inner wall of the impeller chamber.

Further, on the side facing the opening part 133*c* in the direction of the axis line S, the disk part 134 is formed so as to form an inclined surface that slopes downward from the shaft part 131 toward the end wall 21*b* radially outside, in order to guide the fluid sucked from the opening part 133*c* in the radial direction of the shaft part 131.

Here, the disk part 134 is formed as a conical inclined surface, but may be formed as a curved surface that is recessed toward the inlet 12*a* side.

According to the impeller 130 having the above configuration, there is no conventional hub plate, and only the shaft part 131, the plurality of blades 132 extending from the outer periphery of the shaft part 131, the shroud plate 133 covering the tip side area of the plurality of blades 132 on the inlet 12*a* side, and the disk part 134 are included. Therefore, the following effects can be obtained.

Since there is no hub plate that covers the entire blade as conventionally, problems such as deterioration of sealing performance around the driving shaft due to a pressure drop on the back side of the hub plate, which has occurred in a conventional impeller, are solved.

Further, by providing the disk part 134 having a smaller outer diameter than the hub plate, the weight can be reduced, the moment of inertia can be reduced, the friction loss between the hub plate and the fluid can be reduced, and the responsiveness can be improved.

In addition, by providing the disk part 134, mechanical strength of a connected portion between the plurality of blades 132 and the shaft part 131 can be increased.

Further, by providing the disk part 134, the fluid flowing from the inlet 12*a* via the opening part 133*c* can be prevented from directly colliding with the protruding surface $\mathbf{21}b_2$ in the vicinity of the driving shaft 22, and the sealing performance of the driving shaft 22 can be maintained.

A relative speed of the fluid flowing between the plurality of blades 132 with respect to a wall surface (end wall 21*b*) of the impeller chamber 13 is less than in a conventional example in which a hub plate is provided covering the entire back side. Therefore, the friction loss of the fluid can be reduced.

Since the shroud plate 133 is disposed on the inlet 12*a* side where the pressure is low, the occurrence of the Rankine vortex (infinitely rotating vortex) can be prevented or suppressed.

Since the shroud plate 133 faces the inner walls 17 and 18 of the housing 10 with a small gap therebetween, leakage of the fluid caused by backflow from the outlet 15*a* side where the pressure is high to the inlet 12*a* side where the pressure is low can be prevented. That is, by disposing the shroud plate 133 on the inlet 12*a* side, deterioration of pump efficiency can be prevented.

When the impeller 130 is molded by a mold or the like, since the outer diameter dimension D1 of the disk part 134 is set equal to or less than the inner diameter dimension D2 of the opening part 133, the mold can be separated in the direction of the axis line S. Therefore, the impeller 130 can be easily integrally molded by a mold by using a metal material or a resin material.

Since the shroud plate 133 is molded integrally with the shaft part 131 and the plurality of blades 132, conventional assembly work is unnecessary, and there is no need to manage the assembly with high accuracy, and the manufacturing cost can be reduced.

The operation when the impeller 130 is incorporated in the centrifugal pump M and applied to an engine cooling water circulation system is the same as described above.

As described above, according to the impeller 130 and the centrifugal pump M having the above configurations, the structure can be simplified, the weight and cost can be reduced, and the impeller 130 can be integrally molded by a mold or the like.

In the above embodiments, the cases are shown where a plurality of blades 32 and 132 included in the impellers 30 and 130 are formed so as to bend as being radially outward from the shaft parts 31 and 131. However, the disclosure is not limited thereto. A plurality of blades extending linearly in the radial direction may be adopted. The number of blades is not limited to eight, and other numbers of blades may be adopted.

In the above embodiments, the configurations are shown in which the impellers 30 and 130 include the fitting holes 31*a* and 131*a* to which the driving shaft 22 is fitted. However, the disclosure is not limited thereto. The driving shaft 22 may be formed as a driving shaft having a male screw, a fitting hole of a shaft part may be formed as a through hole, and a nut fastening an impeller may be adopted in place of the tip parts 31*c* and 131*c*.

In the above embodiments, an electric motor including the driving shaft 22 as a driving source is shown. However, the disclosure is not limited to thereto. For example, when a centrifugal pump is applied to an engine, a pulley driven by rotation of a crankshaft of the engine may be adopted as the driving source, and a rotary shaft of the pulley may be adopted as the driving shaft.

In the above impeller, a configuration may be adopted in which the shroud plate includes a cylindrical part centered on the axis line to be disposed adjacent to the inner wall of the housing on the inlet side.

In the above impeller, a configuration may be adopted in which the plurality of blades are formed so as to bend as being radially outward from the shaft part.

In the above impeller, a configuration may be adopted in which the plurality of blades have, on a side opposite a side where the shroud plate is disposed, a contour along an inner wall of the impeller chamber.

In the above impeller, a configuration may be adopted in which the plurality of blades have a contour whose width in the direction of the axis line increases as being radially away from the shaft part.

In the above impeller, a configuration may be adopted in which, on the side opposite the side where the shroud plate is disposed, a disk part is included extending radially from the shaft part and continuous with the plurality of blades so as to cover a base side area of the plurality of blades.

In the above impeller, a configuration may be adopted in which the disk part is formed to have an outer diameter dimension equal to or less than an inner diameter dimension of an opening part defined by the shroud plate.

In the above impeller, a configuration may be adopted in which the disk part has a contour along the inner wall of the impeller chamber.

In the above impeller, a configuration may be adopted in which the disk part is formed into an inclined surface or a curved surface to guide a fluid, sucked through an opening part defined by the shroud plate, in the radial direction of the shaft part.

In the above impeller, a configuration may be adopted in which the shaft part includes a hemispherical end part protruding toward the inlet side from the plurality of blades on a tip toward the inlet.

In the above impeller, a configuration may be adopted in which the shaft part, the plurality of blades, and the shroud plate are integrally molded.

In the above impeller, a configuration may be adopted in which the shaft part, the plurality of blades, the shroud plate, and the disk part are integrally molded.

A centrifugal pump of the disclosure is a centrifugal pump including a housing having an inlet, an outlet and an impeller chamber, a driving source having a driving shaft, and an impeller disposed in the impeller chamber and connected to the driving shaft, in which an impeller having any of the above configurations is adopted as the impeller.

In the above centrifugal pump, a configuration may be adopted in which the driving source includes a casing defining a part of the impeller chamber.

In the above centrifugal pump, a configuration may be adopted in which the casing includes a protruding surface protruding in a truncated cone shape toward the impeller.

In the above centrifugal pump, a configuration may be adopted in which the driving source is an electric motor.

According to the impeller and the centrifugal pump having the above configurations, the structure can be simplified, the weight and cost can be reduced, and the impeller can be integrally molded by a mold or the like.

As described above, according to the impeller and the centrifugal pump of the disclosure, since the structure can be simplified, the weight and cost can be reduced, and the impeller can be integrally molded by a mold or the like, the impeller and the centrifugal pump can of course be applied as a water pump of an engine cooling water circulation system, and are also useful as a centrifugal pump for transferring other fluids.

What is claimed is:

1. An impeller, disposed in a centrifugal pump comprising a housing having an inlet, an outlet and an impeller chamber, wherein the impeller is disposed in the impeller chamber and rotationally driven by a driving shaft protruding from a casing fixed to the housing, and the impeller comprises:

a shaft part connected to the driving shaft to rotate about an axis line extending toward the inlet;

a plurality of blades directly connected to and extending radially from an outer periphery of the shaft part; and a shroud plate being annular and continuous with the plurality of blades so as to cover a tip side area of the plurality of blades to be disposed adjacent to an inner wall of the housing on an inlet side, wherein the plurality of blades are protruded from a surface of the shroud plate and extend along the axis line toward a casing side that is opposite to the inlet side, and a bottom surface of each of the plurality of blades faces an end wall of the casing in which the end wall of the casing faces the inlet side, wherein on the side opposite the side where the shroud plate is disposed, the impeller further comprises a disk part extending radially from the shaft part and continuous with the plurality of blades so as to cover a base side area of the plurality of blades.

2. The impeller according to claim 1, wherein the shroud plate comprises a cylindrical part centered on the axis line to be disposed adjacent to the inner wall of the housing on the inlet side.

3. The impeller according to claim 1, wherein the plurality of blades are formed so as to bend as being radially outward from the shaft part.

4. The impeller according to claim 1, wherein the plurality of blades have a contour along an inner wall of the impeller chamber on a side opposite a side where the shroud plate is disposed.

5. The impeller according to claim 4, wherein the plurality of blades have a contour whose width in a direction of the axis line increases as being radially away from the shaft part.

6. The impeller according to claim 1, wherein the disk part is formed to have an outer diameter dimension equal to or less than an inner diameter dimension of an opening part defined by the shroud plate.

7. The impeller according to claim 1, wherein the disk part has a contour along the inner wall of the impeller chamber.

8. The impeller according to claim 1, wherein the disk part is formed into an inclined surface or a curved surface to guide a fluid, sucked through an opening part defined by the shroud plate, in the radial direction of the shaft part.

9. The impeller according to claim 1, wherein the shaft part comprises a hemispherical end part on a tip toward the inlet, and the hemispherical end part protrudes toward the inlet side from the plurality of blades.

10. The impeller according to claim 1, wherein the shaft part, the plurality of blades, and the shroud plate are integrally molded.

11. The impeller according to claim 1, wherein the shaft part, the plurality of blades, the shroud plate, and the disk part are integrally molded.

12. A centrifugal pump, comprising:

a housing having an inlet, an outlet and an impeller chamber;

a driving source having a driving shaft; and an impeller disposed in the impeller chamber and connected to the driving shaft, wherein the impeller is the impeller according to claim 1.

13. The centrifugal pump according to claim 12, wherein the driving source comprises a casing defining a part of the impeller chamber.

14. The centrifugal pump according to claim 13, wherein the casing comprises a protruding surface protruding in a truncated cone shape toward the impeller.

15. The centrifugal pump according to claim 12, wherein the driving source is an electric motor.

* * * * *